US006176748B1

(12) United States Patent
Simmel et al.

(10) Patent No.: US 6,176,748 B1
(45) Date of Patent: Jan. 23, 2001

(54) TERMINAL POSITIONING SYSTEM

(75) Inventors: George Marc Simmel, Naperville, IL (US); Chui Ngor Wong, Singapore (SG); Kiat Keen Chee, Singapore (SG); Sebastian Anjilikkal Poulose, Singapore (SG)

(73) Assignee: Molex Incorporated, Lisle, IL (US)

( * ) Notice: Under 35 U.S.C. 154(b), the term of this patent shall be extended for 0 days.

(21) Appl. No.: 09/198,383

(22) Filed: Nov. 24, 1998

(51) Int. Cl.[7] ..... H01R 13/405
(52) U.S. Cl. ..... 439/736; 439/660
(58) Field of Search ..... 439/736, 660, 439/74, 444; 29/842, 848, 733.1

(56) References Cited

U.S. PATENT DOCUMENTS

| | | | |
|---|---|---|---|
| 4,330,935 | 5/1982 | Blair, Jr. et al. | 29/884 |
| 4,418,475 | 12/1983 | Ammon et al. | 29/842 |
| 4,429,459 | 2/1984 | Lynch | 29/881 |
| 4,996,766 | 3/1991 | Piorunneck et al. | 29/842 |
| 5,201,883 | 4/1993 | Atoh et al. | 29/883 |
| 5,310,357 | 5/1994 | Olson | 439/346 |
| 5,359,761 | 11/1994 | Whitson et al. | 29/883 |
| 5,535,513 | 7/1996 | Frantz | 29/882 |
| 5,718,047 | 2/1998 | Nakayama et al. | 29/845 |
| 5,772,474 | 6/1998 | Yagi et al. | 439/660 |

FOREIGN PATENT DOCUMENTS

| | | | |
|---|---|---|---|
| 1108257 | 9/1981 | (CA) | H05K/1/12 |
| 693802 * | 1/1996 | (DE) | H01R/23/70 |
| 0092667 | 6/1986 | (EP) | H01R/43/00 |

* cited by examiner

*Primary Examiner*—Paula Bradley
*Assistant Examiner*—Alexander Gilman

(57) ABSTRACT

An electrical connector includes a housing molded of dielectric material and having a recess defined by opposed side walls having inner surfaces. A plurality of terminals are mounted on the housing and include contact sections along at least one of the opposed side walls and exposed at the inner surface thereof. The terminals have distal ends at an end of the recess. At least some of the terminals have spacer tabs projecting laterally from edges of the contact sections of the terminals to maintain at least a minimum spacing between the distal ends of the terminals prior to molding the dielectric housing.

15 Claims, 7 Drawing Sheets

TERMINAL POSITIONING SYSTEM

FIELD OF THE INVENTION

This invention generally relates to the art of electrical connectors and, particularly, to a system to facilitate positioning terminals in an overmolded housing.

BACKGROUND OF THE INVENTION

Generally, a typical electrical connector includes an insulating or dielectric housing defining some form of mating configuration for mating the connector with a complementary mating connector or other connecting device. For example, the connector housing may define a male or plug connector, or the connector housing may define a female or socket connector. The dielectric housing may be a stand-alone component, or it may be adapted for mounting on a printed circuit board, in a panel or in association with other mounting structures.

One or more conductive terminals are mounted on or in the connector housing. The terminals can have a wide range of configurations depending on the use of the connector. However, the terminals typically have contact portions for engaging the contact portions of terminals in the complementary mating connecting device. One type of terminal is a stamped and formed terminal of sheet metal material, and such terminals may have a contact leg or blade of flat sheet metal material.

Some form of retention system must be employed to hold the terminals on or in the connector housing. The retention systems also vary widely. The terminals may be press-fit into terminal-receiving cavities, or the terminals may have latching portions for latching with complementary latches on the connector housing. One form of retention system involves overmolding a plastic housing about portions of the terminals to rigidify and hold the terminals on the housing.

One problem with overmolding terminals as described above concerns maintaining portions of the terminals, such as the contact portions, at proper positioning, spacing or pitch during the overmolding process. This is particularly problematic with the ever-increasing miniaturization of electrical connectors, whereby the terminals are very small and the contact portions of the terminals are extremely narrow and closely spaced. For instance, if the contact portions or other portions of the terminals are so closely spaced as to be touching each other, corresponding portions of the molding die may not even be able to be positioned between the terminal portions. The terminal portions actually can be damaged when the mold tooling is closed. In addition, when the molten dielectric (plastic) material is inserted into the mold, the material is under high pressure and can actually move or bend the terminal portions. The present invention is directed to solving these problems in such electrical connectors which include dielectric housings overmolded about metal terminals.

SUMMARY OF THE INVENTION

An object, therefore, of the invention is to provide an electrical connector with a new and improved system to facilitate positioning terminals during an overmolding process.

In the exemplary embodiment of the invention, an electrical connector includes a housing molded of dielectric material and having a recess defined by opposed side walls having inner surfaces. A plurality of terminals are mounted on the housing and include contact sections along at least one of the opposed side walls and exposed at the inner surface thereof. The terminals have distal ends at an end of the recess. At least some of the terminals have a spacer tab projecting laterally from an edge of the contact section of the terminal to maintain at least a minimum spacing between the distal ends of the terminals prior to molding the dielectric housing.

As disclosed herein, the terminals are at least partially insert-molded in the housing. Preferably, each terminal has one of the spacer tabs projecting from each opposite edge of the contact section of the terminal. The distal ends of the terminals are bent at an angle to the contact sections of the terminals outwardly of the recess at the end thereof.

In one embodiment of the invention, the distal ends of the terminals are angled to define a tapered head to engage a correspondingly tapered recess in a wall of a mold cavity. In another embodiment of the invention, the distal ends of the terminals are curved to define a curved head to engage a correspondingly curved recess in a wall of a mold cavity. Preferably, the curved distal ends of the terminals are parabolic.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENTS

Figure 1:
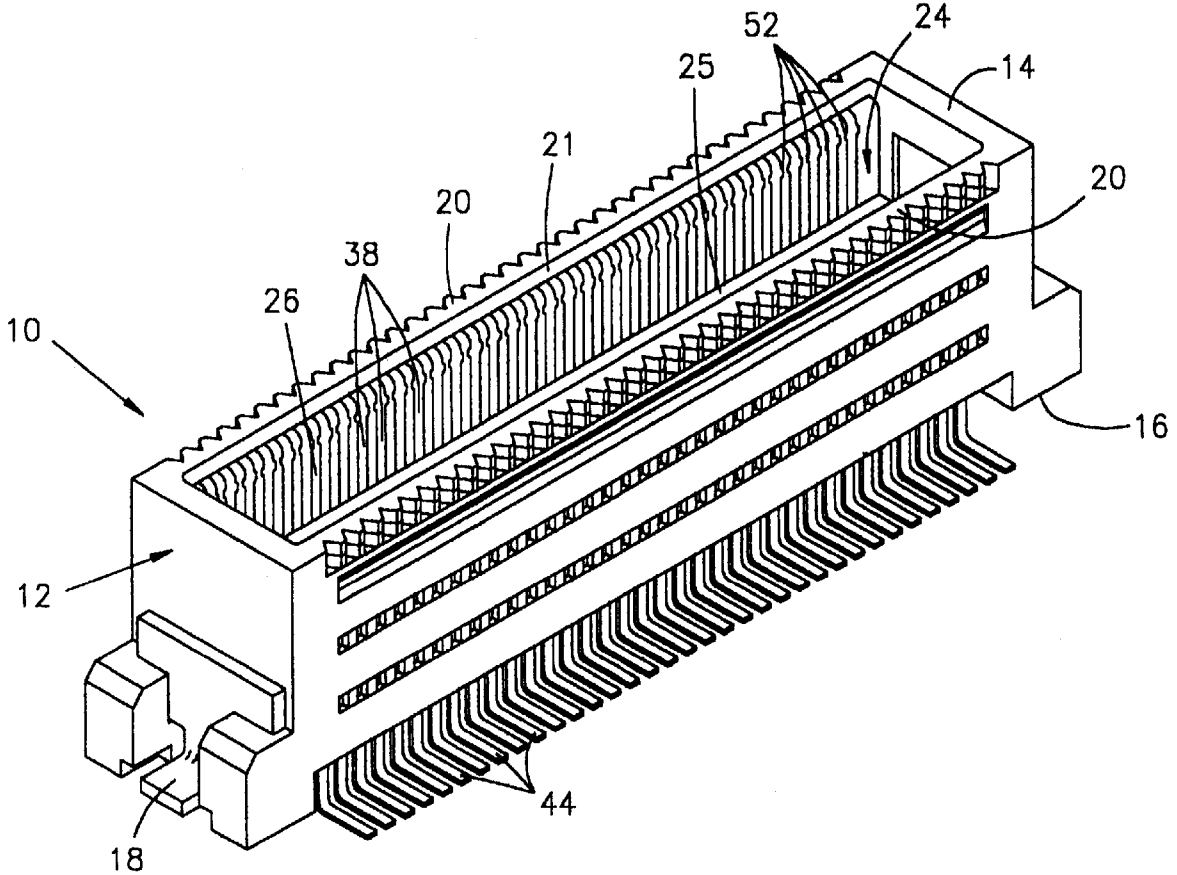
FIG. 1 is a top perspective view of an electrical connector embodying the concepts of the invention.

Referring to the drawings in greater detail, and first to FIGS. 1–6, the invention is embodied in an electrical connector, generally designated 10, which is designed for mounting on a circuit board. The connector includes a one-piece dielectric housing, generally designated 12, molded of plastic material or the like. The housing defines a mating end 14 and a mounting end or face 16. The housing is elongated and includes a metal securing member or "fitting nail" 18 at each longitudinal end thereof for fixing, as by soldering, to a pair of spaced securing pads on the circuit board. Mating end 14 of the housing has opposed side walls 20 including upper portions 21 that define a mating recess, generally designated 24, and a bottom wall 25. The upper portions 21 of opposed side walls have upper, inner surfaces 26.

The housing also defines an elongated mounting recess, generally designated 28, which is bounded by lower portions 30 of opposed side walls 20. The mating recess 24 and mounting recess 28 are separated by a bottom wall 25. Finally, a plurality of stiffening ribs 34 (FIG. 4) are molded integrally with and interconnect lower portions 30 of opposed side walls 20 and span mounting recess 28.

Figure 3:
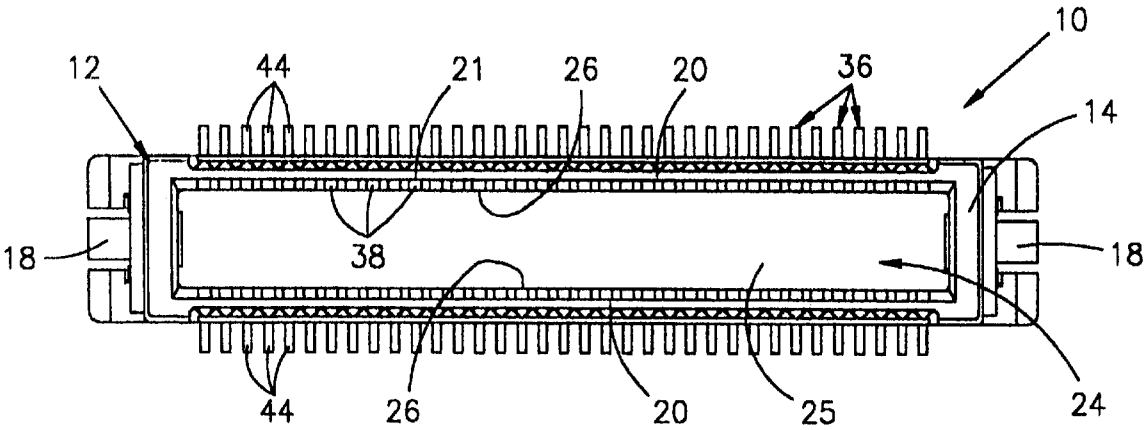
FIG. 3 is a top plan view of the connector.
Figure 4:
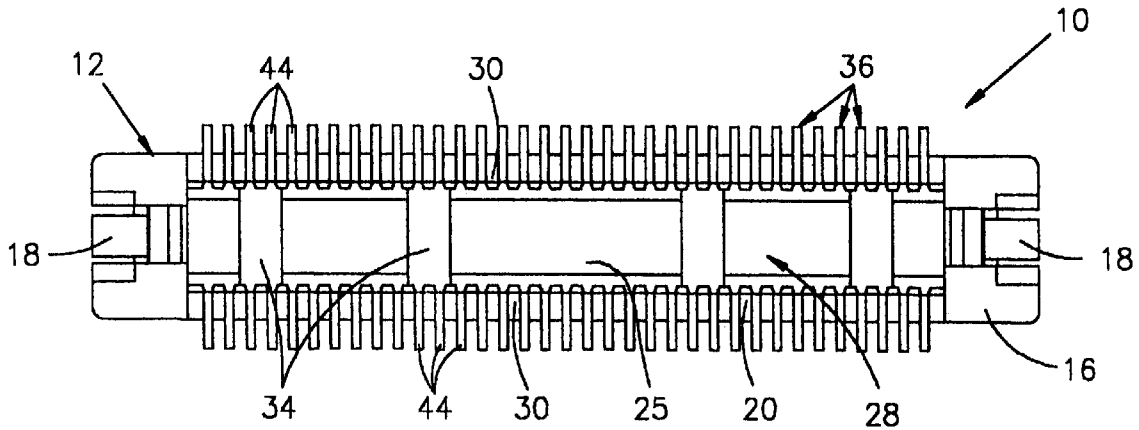
FIG. 4 is a bottom plan view of the connector.
Figure 5:
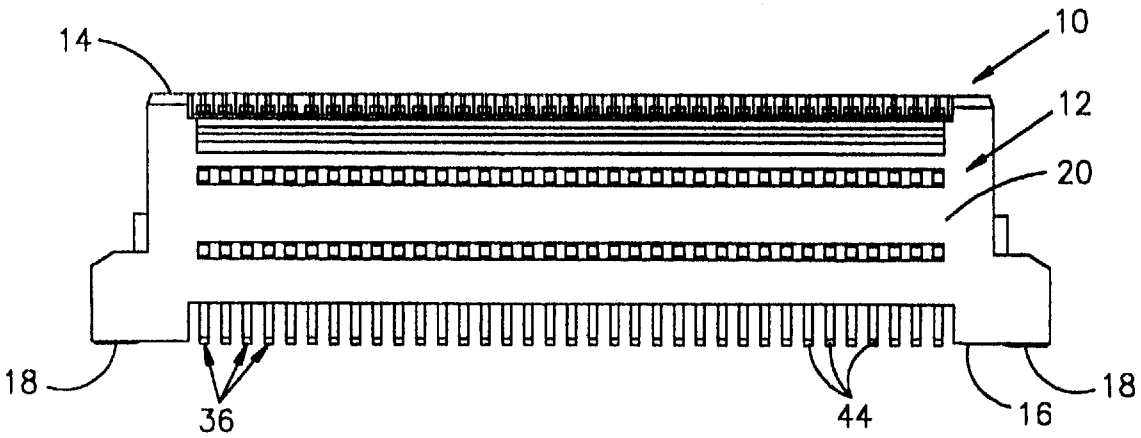
FIG. 5 is a side elevational view of the connector.
Figure 6:
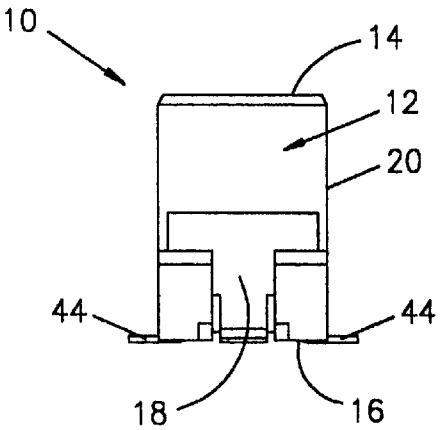
FIG. 6 is an end elevational view of the connector.

A plurality of terminals, generally designated 36, are insert-molded in housing 12 partially in upper portions 21 and lower portions 30 of opposed side walls 20 of mating recess 24 and mounting recess 28, respectively. Each terminal is stamped and formed of conductive sheet metal material and includes a contact section 38 having a distal end 40 bent outwardly at an angle to the contact section, and a retention section 42 having a solder tail 44 bent outwardly at an angle to the retention section. As best seen in FIGS. 1 and 3, contact sections 38 of the terminals have inside faces generally flush with inner surfaces 26 of opposed side walls 20.

Figure 2:
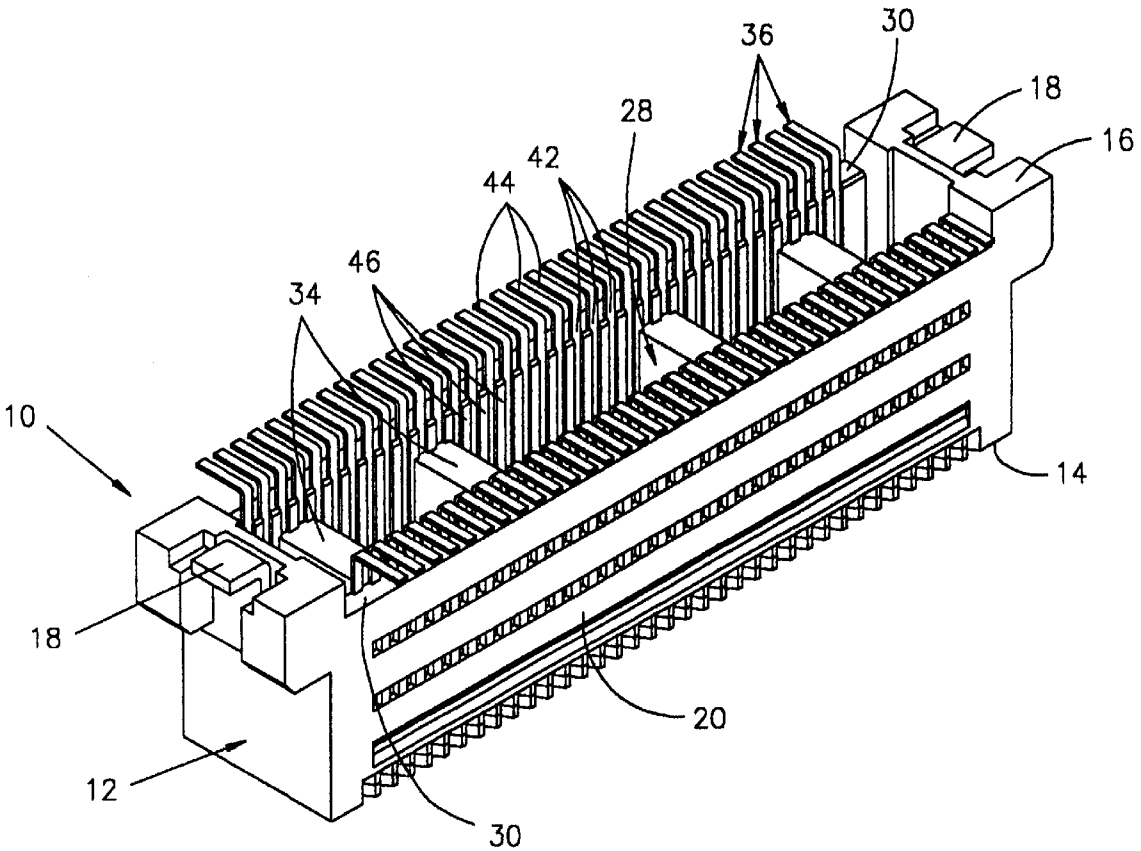
FIG. 2 is a bottom perspective view of the connector.
Figure 7:
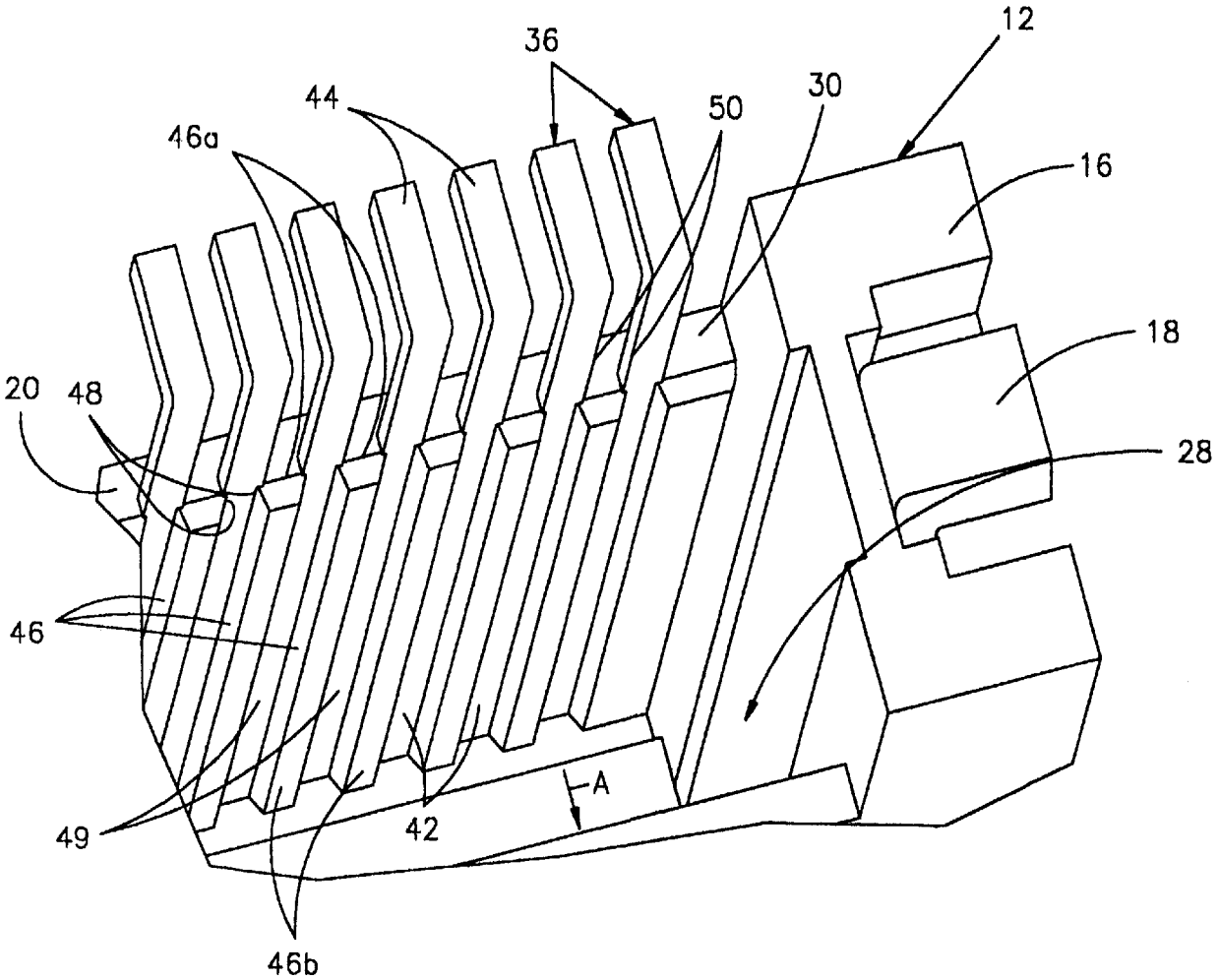
FIG. 7 is an enlarged, fragmented bottom perspective view of one end of the connector.

FIGS. 2 and 7 best show a system for retaining sections of the terminals in the side walls of the housing. It should be understood that the system is disclosed herein for retaining retention sections 42 of the terminals. However, the system can be used for retaining other sections of the terminals, such as retaining contact sections 38 in side walls 20 within mating recess 24.

With that understanding, and referring to FIGS. 2 and 7, a plurality of ribs 46 are molded integrally with housing 12 to project inwardly of opposed side walls 20 between retention sections 42 of adjacent terminals 36. Side edges 48 of the ribs are molded to overlap and tightly capture side edges 50 of the terminal retention sections. Therefore, the ribs will resist any inward movement of the retention sections in the direction of arrow "A" (FIG. 7).

Preferably, ribs 46 are trapezoidal in cross-section as clearly seen in FIG. 7. The ribs are oriented such that the side edges of the ribs which overlap the side edges of the terminal retention sections are at the corners of the widest sides 46a of the ribs. The narrowest sides 46b of the ribs face inwardly into recess 28.

Figure 8:
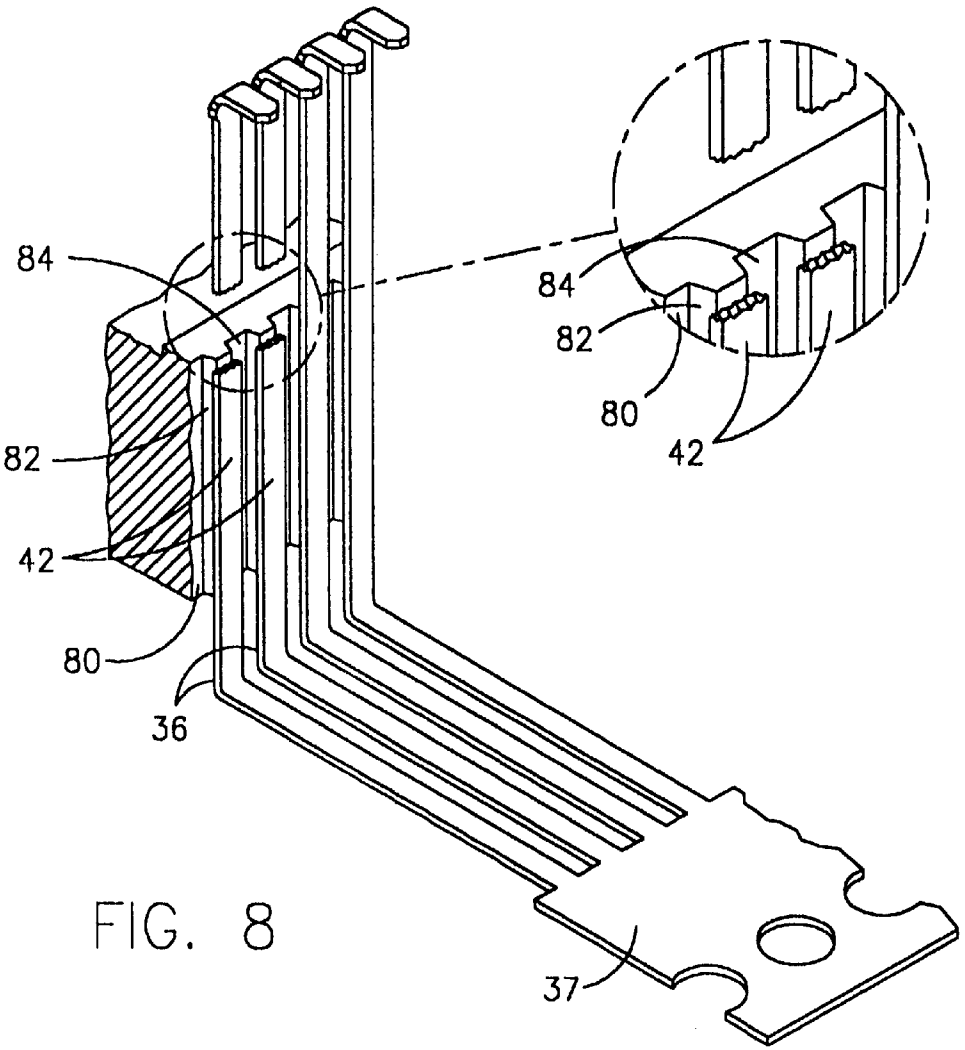
FIG. 8 is a fragmented and enlarged view of retention sections of terminals according to one embodiment of the invention juxtaposed with an inner wall of the mold cavity.

FIG. 8 shows terminals 36 on a carrier 37 being positioned against an inner wall 80 of a mold cavity before molten plastic is injected around the terminals. The two left terminals 36 in FIG. 8 are truncated for illustrative purposes. The inner wall 80 of the mold cavity has an array of projecting terminal supports 82 defining valleys 84 between adjacent terminal supports. When the molten plastic is injected into the mold cavity, plastic filling the valley 84 forms ribs 46. The projections 82 engage terminal retention sections 42. The terminal supports 82 are tapered inwardly to create diverging mouths 49 between adjacent ribs 46 to facilitate withdrawing the terminal supports inwardly from the terminals 36 after the ribs are overmolded over the edges of the terminals.

Figure 9:
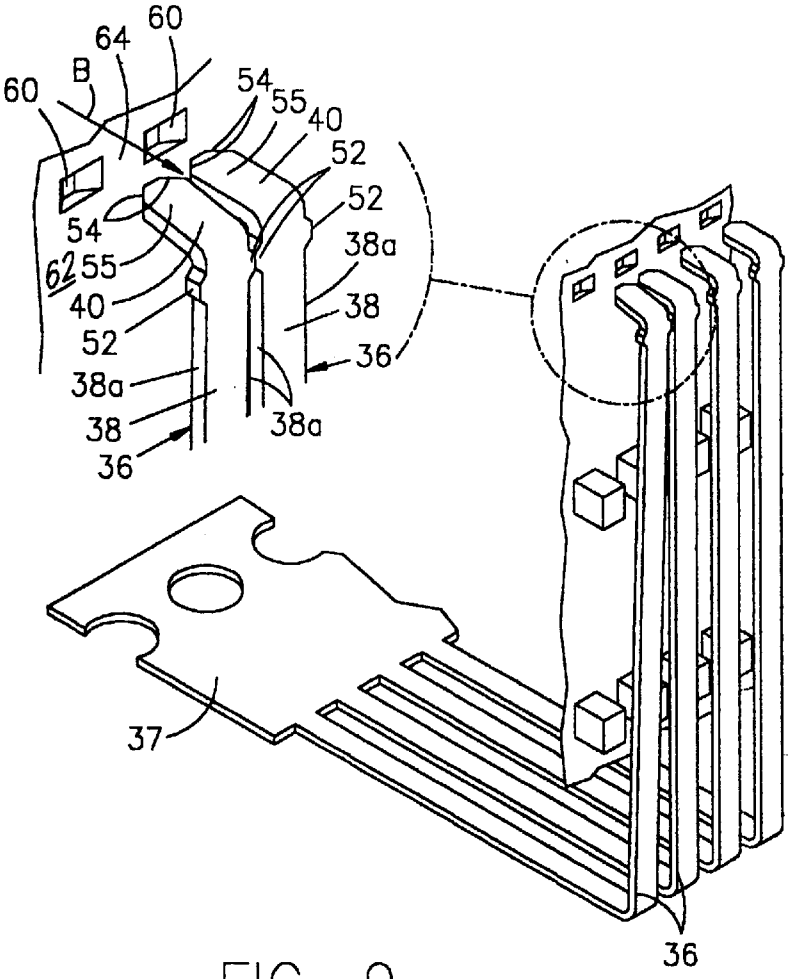
FIG. 9 is a fragmented and enlarged perspective view of the distal ends of terminals according to a second embodiment of the invention juxtaposed with an outer wall of a mold cavity.

FIG. 9 shows terminals 36 on the carrier 37 being positioned against on outer wall 62 of a mold cavity before molten plastic is injected around the terminals. To precisely space the terminals in the housing of the connector, distal ends 40 of the terminals 36 are inserted into recesses 60 in outer wall 62 of the mold cavity. FIG. 9 shows that the corners of distal ends 40 of the terminals are angled, as at 54, to define a tapered head 55. The recesses 60 are correspondingly tapered to accurately position each terminal 36 with respect to the mold and, consequently, the housing 12. Angled corners 54 of adjacent terminals 36 provide a tapered mouth between the distal ends of each pair of adjacent terminals. The tapered mouth is in line with arrow "B" which defines the insertion direction of the partition 64 between adjacent recesses 60 in the wall 62 of the mold cavity.

FIG. 9 shows that each contact section 38 of each terminal 36 has spacer tabs 52 projecting laterally from opposite edges 38*a* of the contact sections. These spacer tabs maintain at least a minimum spacing between the contact sections and, particularly, between distal ends 40 of the terminals. This allows for the partition 64 of the wall 62 of the mold to enter between the distal ends 40 of the terminals in the direction of arrow "B" when the heads 55 are inserted into recesses 60. Preferably, the spacer tabs 52 are as thick as the contact section 38 of the terminal 36 to insure that edges of adjacent tabs 52 abut instead of overlap.

Figure 10:
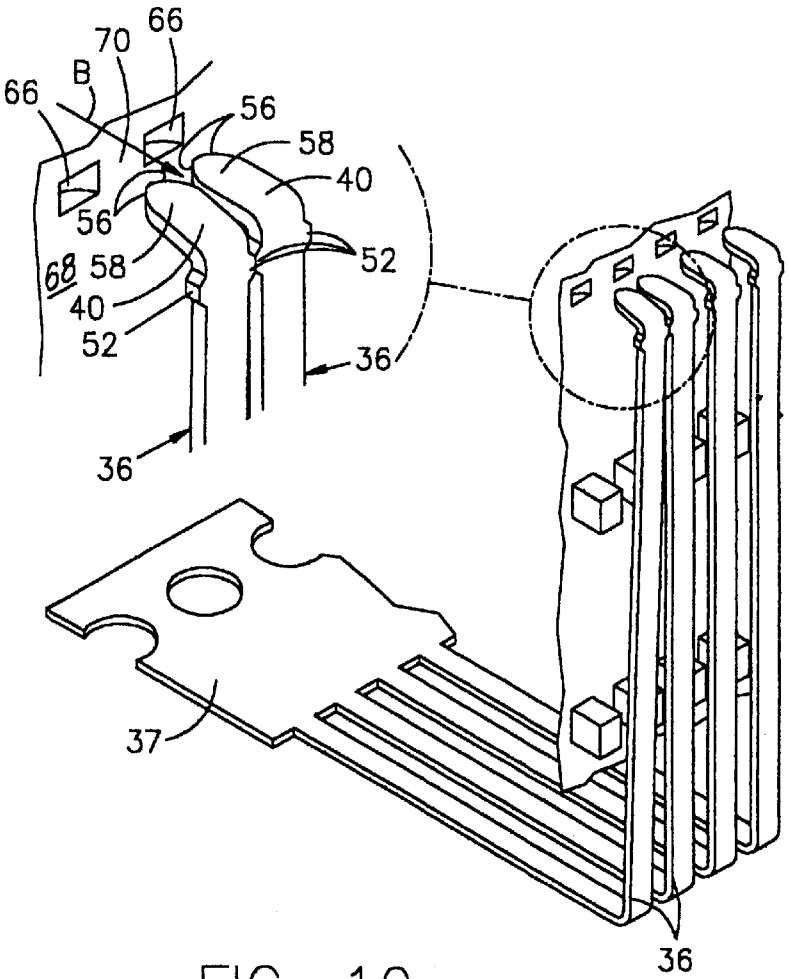
FIG. 10 is a view similar to that of FIG. 9, but with the distal ends of the terminals according to a third embodiment disposed in a mold cavity.

FIG. 10 shows an alternate embodiment wherein the sides of distal ends 40 of terminals 36 are curved, as at 56 to define curved heads 58. The recesses 66 are correspondingly carved to receive curved heads 58. The correspondingly curved heads 58 and recesses 66 include fewer jagged surfaces thereby facilitating smooth insertion of the heads 58 into recesses 66. The curved sides of the distal ends 40 define a rounded mouth between adjacent terminals for receiving the partition 70 between recesses 66 of the mold wall 68 in the direction of arrow "B" when heads 58 are inserted into recesses 66. Preferably, the curvature of rounded sides or edges 56 of distal ends 40 is parabolic to define parabolic profiles for the sides of the mouth which receives the partition 70 between recesses 66 of mold wall 68 when heads 58 are inserted into recesses 66.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. An electrical connector, comprising:

a housing molded of dielectric material and having a recess defined by opposed side walls having inner surfaces; and a plurality of terminals mounted on the housing and including contact sections along at least one of the opposed side walls and exposed at the inner surface thereof, the terminals having distal ends at an end of the recess, and at least some of the terminals having a spacer tab projecting laterally from an edge of the contact section of the terminal to maintain at least a minimum spacing between the distal ends of the terminals prior to molding the dielectric housing; said spacer tab being generally coplanar with said contact section and substantially as thick as said contact section.

2. The electrical connector of claim 1 wherein each terminal has one of said spacer tabs projecting from each opposite edge of the contact section of the terminal.

3. The electrical connector of claim 1 wherein said dielectric housing is of molded plastic material, and the terminals are at least partially insert molded in the housing.

4. The electrical connector of claim 1 wherein said distal ends of the terminals are angled to define a tapered head.

5. The electrical connector of claim 1 wherein said distal ends of the terminals are curved to define a curved head.

6. The electrical connector of claim 5 wherein said curved distal ends of the terminals are parabolic.

7. The electrical connector of claim 1 wherein said distal ends of the terminals are bent at an angle to the contact sections of the terminals outwardly of the recess at the end thereof.

8. The electrical connector of claim 7 wherein said distal ends of the terminals are angled to define a tapered head.

9. The electrical connector of claim 7 wherein said distal ends of the terminals are curved to define a curved head.

10. The electrical connector of claim 9 wherein said curved distal ends of the terminals are parabolic.

11. An electrical connector, comprising:

a dielectric housing having an open ended recess defining a mating end of the housing for receiving complementary mating connector device, the recess being defined by opposed side walls having inner surfaces; and a plurality of terminals mounted on the housing and including contact sections spaced along said opposed side walls and exposed at the inner surface thereof, the terminals having distal ends bent at angles to the contact sections outwardly of the recess thereof, and each terminal having a spacer tab projecting outwardly from each opposite edge of the contact section of the terminal to maintain at least a minimum spacing between the distal ends of the terminals prior to molding the dielectric housing; said spacer tab being generally coplanar with said contact section and substantially as thick as said contact section.

12. The electrical connector of claim 11 wherein said dielectric housing is of molded plastic material, and the terminals are at least partially insert molded in the housing.

13. The electrical connector of claim 11 wherein said distal ends of the terminals are angled to define a tapered head.

14. The electrical connector of claim 11 wherein said distal ends of the terminals are curved to define a curved head.

15. The electrical connector of claim 14 wherein said curved distal ends of the terminals are parabolic.

* * * * *